United States Patent [19]

Arkin

[11] 3,992,805

[45] Nov. 23, 1976

[54] BUDGETARY SAVINGS BANK

[75] Inventor: Rose G. Arkin, New York, N.Y.

[73] Assignee: Lawrence Peska Associates, Inc., New York, N.Y. ; a part interest

[22] Filed: July 18, 1975

[21] Appl. No.: 597,032

[52] U.S. Cl. ..... 46/2

[51] Int. Cl.[2] ..... A63H 33/00

[58] Field of Search ..... 46/2–5

[56] References Cited

UNITED STATES PATENTS

| | | | |
|---|---|---|---|
| 997,695 | 7/1911 | Ostlund | 46/4 |
| 1,918,691 | 7/1933 | Eschenbacher | 46/4 |
| 2,510,884 | 6/1950 | Greene | 46/2 |

OTHER PUBLICATIONS

"Toys" publication, Chilton Books, copyright 1962, p. 97.

*Primary Examiner*—Louis G. Mancene
*Assistant Examiner*—Robert F. Cutting
*Attorney, Agent, or Firm*—Jack D. Slobod

[57] ABSTRACT

A toy bank for receiving and segregating coins for different budgetary purposes includes a base portion in the shape of a bird nest which carries three drawers. Each of three bird figures formed on top of the base have an open beak exposing a coin slot in the figure leading through a channel to a different one of the three drawers. Each coin slot is of the same size.

1 Claim, 2 Drawing Figures

BUDGETARY SAVINGS BANK

FIELD OF THE INVENTION

The present invention relates to toy banks and coin holders. In its particular aspects the present invention relates to a toy bank having plural coin reservoir compartments, each reservoir being adapted to be filled with coins of plural denominations.

DESCRIPTION OF THE PRIOR ART

In the prior art various devices have been provided for receiving and segregating coins according to denomination or size.

OBJECTS OF THE INVENTION

It is an object of the present invention to provide a toy bank for permitting and encouraging coins to be segregated for plural bugetary purposes.

It is a further object of the present invention to provide a toy savings bank with plural drawers for coins saved for plural corresponding budgetary purposes.

SUMMARY OF THE INVENTION

Briefly the aforementioned and other objects of the present invention are satisfied by providing a toy savings bank divided into plural coin reservoirs, each reservoir fed by a separate coin slot of the same size.

Other objects, features and advantages of the present invention will become apparent upon perusal of the following detailed description of the present invention when taken in conjunction with the appended drawing wherein:

FIG. 1 is a front elevation view of the budgetary savings bank of the present invention; and FIG. 2 is a front elevation view similar to FIG. 1 but in cross-section.

DETAILED DESCRIPTION

Figure 1:
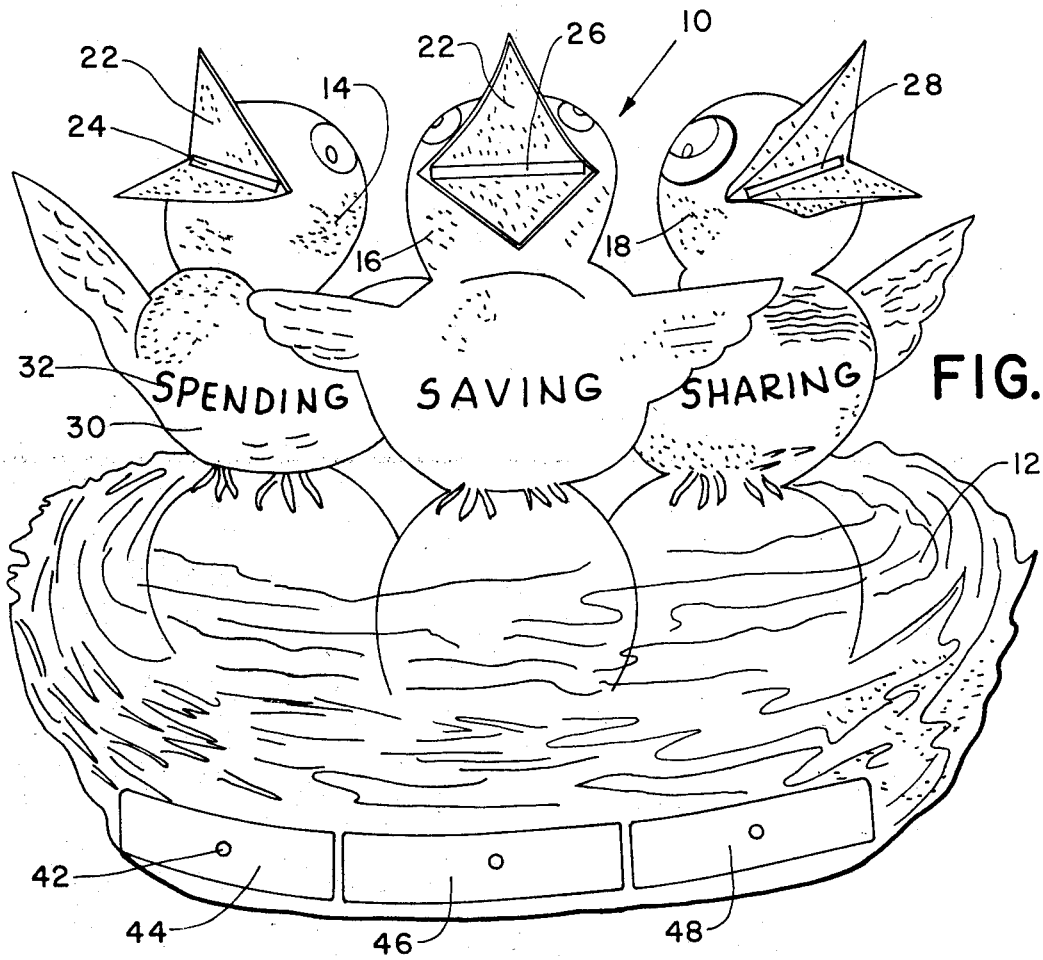
Figure 2:
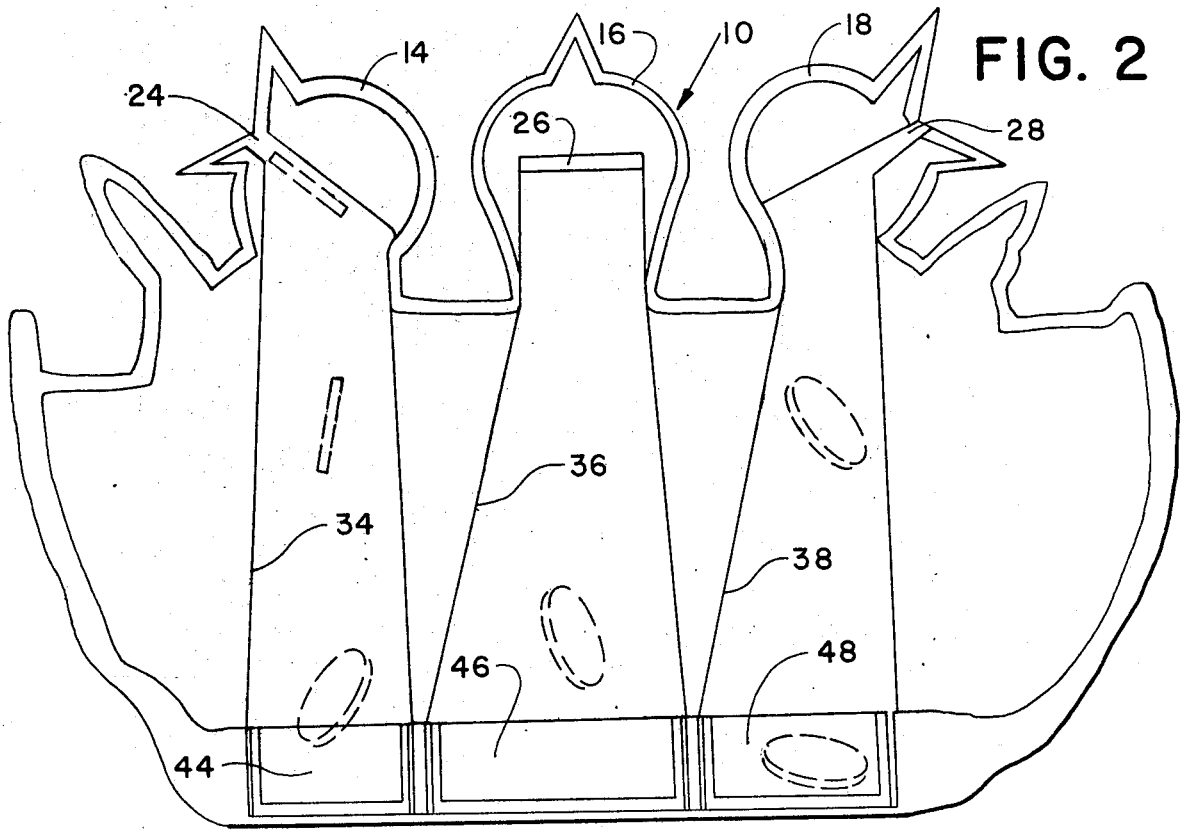

Referring to FIGS. 1 and 2, the budgetary savings bank 10 of the present invention comprises a hollow unit formed of ceramic or plastic. The bank 10 includes a domed base portion 12 generally in the shape of a bird nest on top of which are formed three side by side bird figures 14, 16 and 18 standing on separate egg figures 20 on the nest shaped base portion. Each of the bird figures has an open beak 22. Coin slots 24, 26 and 28 are respectively formed in the beaks of the bird figures 14, 16, and 18 leading to the hollow interiors of the bird figures.

Coin slots 24, 26 and 28 are each of the same size, and are preferably to proportioned to receive 25 cent pieces, in order to receive coins ranging from 1 cent to 25 cents in denomination.

On the breast portion 30, of each bird figure a different word 32 is printed indicative of the budgetary purpose for which a particular one of the coin slots 24 through 28 are selected for coin deposit.

The interior of each bird figure 14, 16 and 18 respectively comprise downwardly expanding chutes or channels 34, 36, and 38 communicating respectively with coin slots 24, 26, and 28. Respectively below the bottom end 40 of each of the chutes 34, 36 and 38 three slideable drawers 44, 46 and 48 having pull knobs 42, are carried in base portion 12 in side by side relationship. The drawers 44, 46 and 48 comprise separate coin reservoirs for the coins deposited respectively through coin slots 24, 26 and 28.

Having described in detail the preferred embodiment of the invention, it should be apparent that numerous modifications, additions and omissions in the details thereof are possible within the intended spirit and scope of the invention. Accordingly, the following claims define the invention.

What is claimed is:

1. A toy bank for receiving coins for plural budgetary purposes comprising: a hollow base portion formed in the shape of a bird's nest; plural side by side drawers mounted slideably in said base portion for holding coins respectively for said different budgetary purposes; plural bird figures on said base portion, each bird figure being positioned above a different one of said drawers; each bird figure having an open beak defining a coin slot proportioned for receiving 25 cent pieces therethrough and chute means within each bird figure leading from the coin slot in each bird figure to the respective drawer below the bird figure.

* * * * *